US005378410A

United States Patent [19]

Erbse et al.

[11] Patent Number: 5,378,410

[45] Date of Patent: Jan. 3, 1995

[54] PROCESS AND FILLING ADAPTER FOR THE IN-DRUM DRYING OF LIQUID RADIOACTIVE WASTE

[75] Inventors: Dietmar Erbse, Rodenbach; Reinhard Thiele, Frankfurt; Helmut Walter, Offenbach, all of Germany

[73] Assignee: Siemens Aktiengesellschaft, Munich, Germany

[21] Appl. No.: 7,055

[22] Filed: Jan. 21, 1993

[30] Foreign Application Priority Data

Jul. 20, 1990 [DE] Germany ..... 4023162

[51] Int. Cl.[6] ..... G21F 9/08; G21F 9/22

[52] U.S. Cl. ..... 588/16; 159/DIG. 12; 422/903; 422/159; 250/506.1

[58] Field of Search ..... 252/632, 633; 250/506.1; 422/159, 903; 159/DIG. 12, 47.3, 43.1; 976/DIG. 381, DIG. 388

[56] References Cited

U.S. PATENT DOCUMENTS

| | | | |
|---|---|---|---|
| 3,688,795 | 9/1972 | Taylor | 137/558 |
| 4,040,973 | 8/1977 | Szivós et al. | 252/632 |
| 4,439,403 | 3/1984 | Brunner et al. | 422/159 |
| 4,566,204 | 1/1986 | Friesner et al. | 34/15 |
| 4,626,414 | 12/1986 | Baatz et al. | 422/159 |
| 4,675,129 | 6/1987 | Baatz et al. | 252/633 |
| 4,717,510 | 1/1988 | James | 252/628 |
| 4,902,446 | 2/1990 | Erbse et al. | 252/632 |
| 4,987,313 | 1/1991 | Baatz et al. | 250/506.1 |

FOREIGN PATENT DOCUMENTS

| | | |
|---|---|---|
| 1639299 | 11/1972 | Germany . |
| 3009005 | 8/1981 | Germany . |
| 3200331 | 7/1987 | Germany . |

OTHER PUBLICATIONS

International Search Report.

*Primary Examiner*—Donald P. Walsh
*Assistant Examiner*—Ngoclan T. Mai
*Attorney, Agent, or Firm*—Herbert L. Lerner; Laurence A. Greenberg

[57] ABSTRACT

A process for in-drum drying of liquid radioactive waste includes sealing a shielded container by placing a plug in a central opening formed in a lid of the container. The plug is removed from the opening and a filling adapter having an outside diameter that fits the opening is inserted into the opening. To measure the fill level a sensor is inserted into the filling adapter and protrudes from a free end of the filling adapter into the interior of the container. Liquid radioactive waste is poured into the sealed container and vapors are vented from the container, through the filling adapter. The liquid radioactive waste is heated in the container with a heater. A filling adapter for in-drum drying of liquid radioactive waste includes a rectilinear, preferably cylindrical steel casing with end regions, an outer periphery, a flange protruding past the outer periphery at one of the end regions, at least two connection points at another of the end regions, and a filling line extending from one of the connection points through the steel casing.

4 Claims, 2 Drawing Sheets

PROCESS AND FILLING ADAPTER FOR THE IN-DRUM DRYING OF LIQUID RADIOACTIVE WASTE

CROSS-REFERENCE TO RELATED APPLICATION

This application is a continuation of International Application Ser. No. PCT/DE91/00348, filed Apr. 25, 1991.

SPECIFICATION

The invention relates to a process for in-drum drying of liquid radioactive waste that is poured into a container which is sealed with a cap and is heated therein with a heater. The subject of the invention is also a filling adapter that is especially suitable for performing the process.

Methods for in-drum drying in which liquid radioactive waste is converted into a solid waste product by the thermal removal of water are known, such as from German Published, Prosecuted Application DE 30 09 005 B1, corresponding to U.S. Pat. No. 4,439,403; and German Patent DE 32 00 331 C2, corresponding to U.S. Pat. No. 4,626,414).

In a known in-drum drying process disclosed by German Patent DE-PS 1 639 299, an open, standard 200-liter drum is pressed against a drying hood that includes connections and a filling neck for the waste that is to be concentrated. The drum is quite thin-walled and in particular is constructed as a sheet-metal drum. That requires an undesirably large amount of space, because the so-called hot zone or radiation zone, in which the drum can be manipulated for transporting and having its lid applied only by remote control because of the danger of radiation, as a rule must be separated from the so-called "cold zone" or operating zone by shielding or a wall. Moreover, that kind of drum is not appropriate for final disposal.

It is accordingly an object of the invention to provide a process and a filling adapter for the in-drum drying of liquid radioactive waste, which overcome the hereinafore-mentioned disadvantages of the heretofore-known methods and devices of this general type and in which the packaging for liquid waste is provided in such a way that the radiation exposure to humans is made especially low at little cost or effort.

With the foregoing and other objects in view there is provided, in accordance with the invention, a process for in-drum drying of liquid radioactive waste, which comprises sealing a shielded container by placing a plug in a central opening formed in a lid of the container; removing the plug from the opening; inserting a filling adapter having an outside diameter that fits the opening into the opening; pouring liquid radioactive waste into the sealed container and venting vapors from the container, through the filling adapter; and heating the liquid radioactive waste in the container with a heater.

A relatively thick-walled a cast container is preferably used as the shielded container, for example a drum or container having a wall thickness of 200 mm. Such a container thus itself functions as a shielding element, so that the aforementioned wall can be made thinner or omitted entirely. The container may be an authorized typical final disposal container.

With the shielded or final disposal container, the radiation exposure is reduced not only during packaging but also during the ensuing removal from that site.

The lid contributes to this as well, because only extremely little stray radiation can escape, and only upward, through its relatively small center opening. Moreover, because the adapter is used, the expenditure of labor for connecting the filling and vapor lines and for the closure of the small center opening which is still necessary at the end is low. The diameter of the center opening is in fact from 10 to 30% of the outside diameter of the shielded container, so that it can be completely sealed with a correspondingly small plug. This plug is also constructed in such a way that it acts as a radiation shield in the installed state. It is only for the brief period when the plug is removed that is there any possibility that stray radiation will escape.

In accordance with another mode of the invention, there is provided a process which comprises mounting the adapter by placing a laterally protruding flange on the lid and preferably in a recess in the lid, and inserting a free end of the filling adapter into the opening without the free end of the filling adapter protruding below a lower surface of the lid.

In accordance with a further mode of the invention, there is provided a process which comprises inserting a fill level sensor, preferably a measuring tube for dynamic pressure measurement, protruding from a free end of the filling adapter, into the interior of the container. In this way, the most accurate possible measurement will be obtained.

With the objects of the invention in view, there is also provided a filling adapter for in-drum drying of liquid radioactive waste, comprising a rectilinear, preferably cylindrical, steel casing with end regions, an outer periphery, a flange protruding past the outer periphery at one of the end regions, at least two connection points at another of the end regions, and a filling line extending from one of the connection points through the steel casing, and particularly in the center of the steel casing.

The adapter is supported on the lid by the flange. Since it protrudes onto the opening of the lid, it is then centered both horizontally and vertically on the shielded container.

In accordance with another feature of the invention, the connection points are located on the outside, in other words on the casing or on the periphery of the steel casing. A support for the filling adapter can then engage the end of the steel casing facing away from the flange.

In accordance with a further feature of the invention, the support includes a drive that is adjustable in the direction of the longitudinal axis of the steel casing. The drive serves to set the steel casing on the lid and to remove it.

In accordance with an added feature of the invention, the drive is an actuating drive, preferably operating with compressed air, which is well adapted to rectilinear motion and can be simple in structure.

In accordance with an additional feature of the invention, there is provided a sealing lid disposed on the other end region of the steel casing facing away from the flange.

In accordance with a concomitant feature of the invention, there is provided a plug having a T-shaped cross section and dimensions corresponding to dimensions of the steel casing and the flange.

Other features which are considered as characteristic for the invention are set forth in the appended claims.

Although the invention is illustrated and described herein as embodied in a process and a filling adapter for the in-drum drying of liquid radioactive waste, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
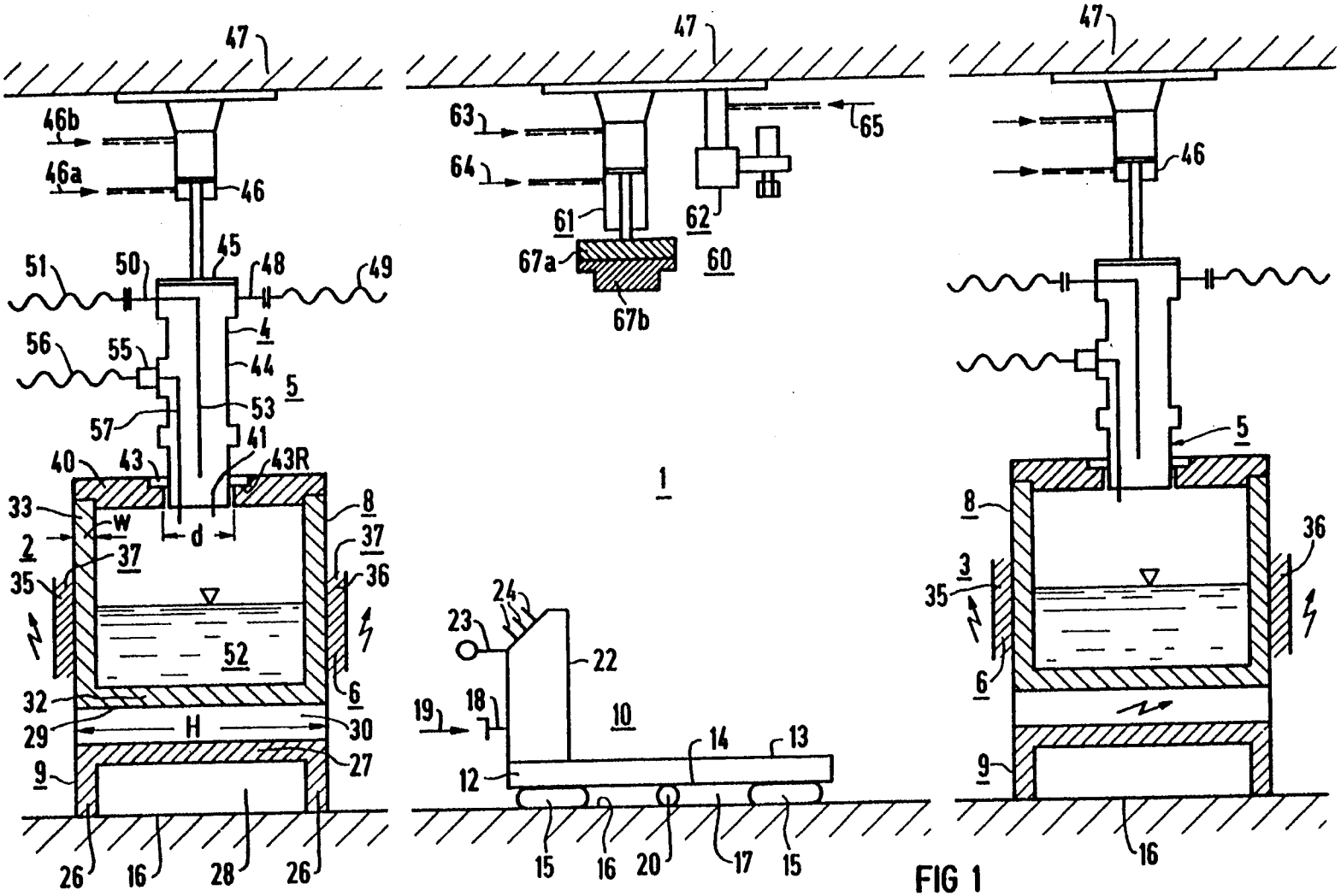
FIG. 1 is a diagrammatic, partly sectional, side-elevational view of a device for in-drum drying according to the invention.

Referring now to the figures of the drawing in detail and first, particularly, to FIG. 1 thereof, there is seen a device 1 that is used for in-drum drying of liquid radioactive waste of the kind produced in a nuclear power plant with a pressurized or boiling water reactor, for example. Above all, the waste is residue from a system for treating radioactive waste water, namely so-called evaporator concentrates, which primarily are formed of water-soluble salts, such as boric acid salts. The waste may also involve suspensions and slurries of filter resins or the like.

By way of example, the drive 1 includes two drying stations 2 and 3, which are disposed next to one another in a building, only parts of which are shown, and each of which has a filling adapter 5 and a main heater 6. The drying stations are charged with identical barrels or shielded containers 8, which sit on transport pallets 9. In order to transport the pallets 9, the device 1 includes a hovercraft transporter 10, for example. Instead, some other transport device may also be used, such as an electrically driven device including a rail vehicle, for instance.

The hovercraft transporter 10 has a base body 12 with a horizontal loading surface 13. Extending around an edge of a lower surface or underside 14 of the base body 12 is an annular hose 15, which defines at least one air chamber 17 along with a building floor 16. If the air chamber 17 is filled with externally generated compressed air from a compressed air connection 18, as is indicated by an arrow 19, then the base body 12 is lifted. The base body 12 is then easily movable to all sides with a friction wheel 20, which is in contact with the floor 16 and is actuated by a non-illustrated compressed air motor. Through the use of the friction wheel 20, the hovercraft transporter 10 can also be safely braked.

The compressed air connection 18 leads into an operating panel 22, which is either mounted on one end surface on the base body 12 or is constructed with lengthened hoses as a panel for remote control. Through the use of diagrammatically indicated hand grips 23 and switches 24 of the operating panel 22, for instance, a drive of the friction wheel 20, including its steering, is controlled. These means are also used to adjust the pressure in the air chamber 17 and/or in the hose 15. In this way, the height of the top or loading surface 13 for picking up and setting down the pallets 9, is regulated.

The transport pallet 9 is preferably made of metal. By way of example, a pallet 9 may be produced as a cast piece of lightweight metal or iron. The pallet 9 can also be made as a welded structure of steel shells. The pallet 9 has feet 26 which are located on both sides of a pallet bottom 27, forming an intermediate space or clearance 28. The hovercraft transporter 10 can move into this intermediate space 28 with its base body 12. Each pallet 9 has a top 29 which is formed by a supplementary or ground heater 30 in the pallet 9. The shielded container 8 is located on the top 29. In the exemplary embodiment, an electric supplementary heater 30 is indicated. However, steam could also be used as the heating energy, for example.

The shielded container 8 is preferably made of cast iron. The shielded container 8 is constructed in one piece and has a bottom 32 and a preferably cylindrical, relatively thick side wall 33 having a wall thickness w of 150 or 200 mm, for example. This wall thickness w is sufficient for adequate shielding against the escape of radioactive radiation. The container may be a final disposal container of the conventional type having dimensions that meet official regulations. The electric heater 6 rests on the side wall 33, once its two shells 35 and 36, which are secured in the applicable drying station 2 or 3 in such a way that they are swivelable in a horizontal plane, have been folded together to form a heating mantle 37 that largely encloses the shielded container 8. In an open position, a space between the shells 35 and 36 covers a distance that is greater than the outside diameter of the shielded container 8 and the width of the pallet 9, so that the shielded container 8 and the pallet 9 fit between them and can be driven directly into that space. The heater 6 is preferably an electrical resistance heater although infrared heating may also be used.

A lid 40 of the shielded container 8 may also preferably be made of cast iron. In operation, the lid 40 is secured to the container 8. The lid 40 has a central opening 41 formed therein with a circular cross section and a diameter d which is a small fraction (such as 1/10) of an inside diameter $D=H-2w$ of the shielded container 8, where H is the outside diameter of the shielded container 8. The filling adapter 5 has a fitting cross section which protrudes into the opening 41. The filling adapter 5 has a flange 43 with which it fits on the lid 40 in a fitting recess 43R.

The filling adapter 5 has an external housing 4 in the form of a tube 44 with a vertical axis, which is sealed with a sealing lid 45 on its upper end and is vertically adjustably secured to a compressed air drive 46, for example. Incoming air for one end and for the other end of the piston is indicated by respective reference symbols 46*a* and 46*b*. The compressed air drive 46 is assigned to the applicable drying station 2 or 3 and is secured above the filling adapter 5, for instance to the building ceiling 47 or to a stage. An electric drive with a lifting spindle may be used instead of the compressed air drive 46.

The tube 44 is a first part of a suction apparatus for vapors that occur during drying and concentration and that are vented to a non-illustrated condenser through a lateral connection 48 with a hose connection 49. Diagonally opposite the connection 48 is a connection 50, to which a hose 51 is secured as part of a charging line. The line 51 serves for controlled venting of the shielded container 8 during drying of the container contents or in other words of radioactive waste 52. In addition, the liquid radioactive waste 52 to be dried is delivered through the charging line 51 and then reaches the inside of the shielded container 8 through an inlet tube 53 that preferably extends in the center of the tube 44, without touching the inner wall of the housing 4.

A further connection 55 with a hose 56 is provided on the housing 4 at, above, or below the connection 50 and leads to a non-illustrated compressed air source. The compressed air acts upon a fill level gauge 57 in the filling adapter 5 that operates by the dynamic pressure measuring principle. Measurement is carried out only during filling of the shielded container 8. During drying, a negative pressure, for example of 0.2 bar absolute, is generated by the suction apparatus 44, 48, 49. The fill level gauge 57 may, for example, include a vibration sensor that serves the purpose of maximum shutoff.

The shielded container 8 is filled or refilled in increments. Once filling is complete, when the contents 52 have been dried, the filling adapter 5 is removed upward from the lid 40, so that the shielded container 8 can be taken by the hovercraft transporter 10 to a manipulator or a sealing station 60. The sealing station 60 includes a plug installer 61 and a screwing tool 62, which are secured next to one another on the building ceiling or stage 47. The plug installer 61 and the screwing tool 62 are both actuated by compressed air, for example, as is indicated by arrows 63, 64 and 65. Instead, an electrical drive may be used. The plug installer 61 has a piston drive and executes a vertical motion with which a plug **67*b* that is detachably secured to a lifting element 67*a*, is inserted into the opening 41 of the lid 40. This plug 67*b* has a T-shaped cross section. The plug 67*b* is secured in place with the aid of the screwing tool 62, producing a package that is appropriate for final disposal and is then taken to a non-illustrated transfer station by the hovercraft transporter 10**. The package is removed from the transfer station to a temporary or final disposal site.

The plug **67*b* can also be removed from the opening 41 in the lid 40 at the beginning of the filling process through the use of the plug installer 61. The plug 67*b* is screwed in or put in place in such a way that it is flush with the surface both at the top and at the bottom. The filling adapter 5 can be structurally combined with the manipulator 60, that is, with the plug puller device or screwing tool 62 on one hand, and with the installer 61** on the other hand.

Figure 2:
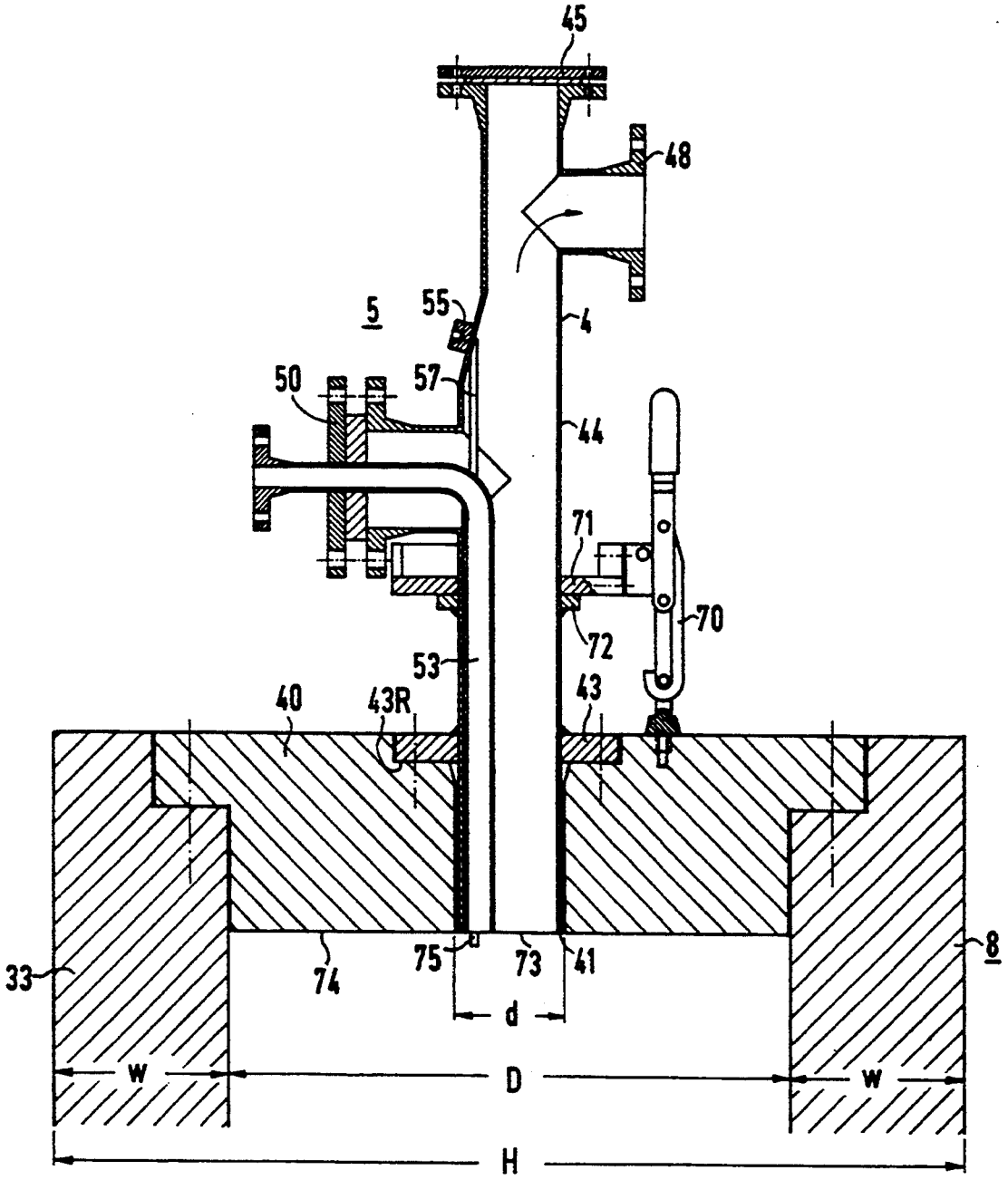
FIG. 2 is an enlarged, fragmentary, vertical-sectional view of a filling adapter of the invention.

The lower end of the housing 4 of the filling adapter 5 shown in FIG. 2 has an outer diameter of 88.9 mm. There, the housing 4 protrudes into the opening 41 which has a diameter that is d=100 mm, for example. The inside diameter D of the shielded container 8 is from 600 to 760 mm, so that for example D=760 mm, and the outside diameter H is 1060 mm, for example, resulting in a diameter ratio d/D of approximately 13%. The wall thickness w=150 mm, which is adequate to protect human handlers if cast iron is used as a shield for typical radioactive waste 52.

The filling adapter 5 is secured to the lid 40 with a manual fixation or a fast-clamping hook 70 which has one end that is screwed into the lid 40 and another end with a collar 71 that fits over a shoulder 72 of the housing 4. In this position, a free end 73 of the housing 4 does not protrude beyond a lower surface or underside 74 of the lid 40. Only the measuring tube 57 for the dynamic pressure measurement of the fill level has a lower end 75 which extends approximately 1 cm beyond the underside 74 of the lid. Instead of the manual fixation 70, a pneumatic or electric pressing device may be provided, for example in the form of the drive 46.

In contrast to the exemplary embodiment of FIG. 1, the drive 46 for mounting and removing the filling adapter 5 need not engage the upper end of the lid 45 but instead the collar 71 may form the part of the support of the filling adapter 5 that is connected to the drive 46. The drive 46 may be under remote control. Placing the filling adapter 5 on the lid 41 and removing it from that location can also be done by hand.

The following summary can be given: The filling adapter 5 serves the purpose of direct in-drum drying in a package that has the necessary shielding and to which a suitable supplementary heater 30 can be applied. In itself, it combines the necessary connections for filling the liquid waste 52, the vent 48, 49 for the vapors, and the fill level gauge 57. Through the use of the connections 48, 50, 55, which are provided with the flexible hoses 49, 51, 56, simple manipulation is achieved, which makes it possible to merely place the filling adapter 5 on the hole 41 located in the center of the package and press it against it, making further alignment or adaptation to further openings and a further connection for the lines required for the process unnecessary. When the filling adapter 5 is removed from the filled package, only the small center hole 41 is exposed. This minimizes stray radiation and enables rapid sealing with the shielding plug **67*b***.

We claim:

1. A process for in-drum drying of liquid radioactive waste, which comprises:

removing a plug from a central opening formed in a lid of a container having been sealed with the plug;

inserting a filling adapter having an outside diameter that fits the opening into the opening;

inserting a fall level sensor protruding from a free end of the filling adapter into the interior of the container;

pouring liquid radioactive waste into the sealed container and venting vapors from the container, through the filling adapter;

heating the liquid radioactive waste in the container with a heater; and sealing the shielded container by placing the plug in the central opening in the lid of the container.

2. The process according to claim 1, which comprises mounting the adapter by placing a laterally protruding flange on the lid, and inserting a free end of the filling adapter into the opening without the free end of the filling adapter protruding below a lower surface of the lid.

3. The process according to claim 2, which comprises placing the laterally protruding flange in a recess in the lid.

4. The process according to claim 1, wherein the fill level sensor is a measuring tube for dynamic pressure measurement.

* * * * *